US006207043B1

(12) United States Patent
Vicari et al.

(10) Patent No.: US 6,207,043 B1
(45) Date of Patent: Mar. 27, 2001

(54) METHOD OF PREPARING LOW-SULPHUR ALIPHATIC COMPOUNDS

(75) Inventors: Maximilian Vicari, Limburgerhof; Ekkehard Schwab, Neustadt; Marc Walter, Frankenthal; Siegmar Maassen, Ludwigshafen, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/194,126

(22) PCT Filed: Jun. 10, 1997

(86) PCT No.: PCT/EP97/03008

§ 371 Date: Nov. 23, 1998

§ 102(e) Date: Nov. 23, 1998

(87) PCT Pub. No.: WO97/47707

PCT Pub. Date: Dec. 18, 1997

(30) Foreign Application Priority Data

Jun. 11, 1996 (DE) ..... 196 23 291

(51) Int. Cl.[7] ..... C10G 29/20

(52) U.S. Cl. ..... 208/237; 208/208 R; 208/236; 208/240; 208/255; 585/833; 585/864; 585/57

(58) Field of Search ..... 208/236, 208 R, 208/240, 237, 242, 255; 585/833, 865, 857

(56) References Cited

U.S. PATENT DOCUMENTS

| | | | | |
|---|---|---|---|---|
| 3,639,497 | * | 2/1972 | Martel | 260/264 |
| 4,132,631 | * | 1/1979 | Nametkin et al. | 208/236 |
| 4,297,206 | * | 10/1981 | Scheibel | 208/254 |
| 5,689,033 | * | 11/1997 | Forte et al. | 208/236 |

* cited by examiner

*Primary Examiner*—Helane Myers
(74) *Attorney, Agent, or Firm*—Keil & Weinkauf

(57) ABSTRACT

Low-sulfur aliphatic compounds are obtained from olefin-rich starting materials contaminated with organic sulfur compounds.

11 Claims, No Drawings

METHOD OF PREPARING LOW-SULPHUR ALIPHATIC COMPOUNDS

The present invention relates to a process for producing low-sulfur aliphatic compounds and, more particularly, to a process for desulfurizing olefin-rich hydrocarbons by liquid-liquid extraction.

Olefin-rich hydrocarbon mixtures are available in large volumes from crackers. More particularly, vacuum residue oils are converted in thermal crackers (visbreakers, cokers) into low boiling fractions having a high olefin content. These products are for example processed in catalytic processes, such as fluid catalytic cracking (FCC) or hydrocracking, into motor fuels.

A further example of the large-scale industrial use of these olefin-rich hydrocarbon mixtures is hydroformylation for the production of higher aldehydes and/or alcohols by reaction with hydrogen and carbon monoxide in the presence of a catalyst. The resulting alcohols are used for example as solvents or for making plasticizers. It is found in this connection, as generally in the case of many processes for the catalytic further processing of olefin-comprising hydrocarbon mixtures, that the high sulfur content of these mixtures is a problem, since the sulfur compounds frequently act as catalyst poisons. This applies in particular to the olefin-rich hydrocarbon mixtures which are obtained from the thermal cracking of heavy residue oil, since they can have an undesirably high sulfur content, the sulfur impurities taking essentially the form of aromatic compounds, such as thiophene, in particular.

U.S. Pat. Nos. 4,711,968 and 4,922,028 disclose processes for the direct hydroformylation of sulfurous olefin-rich hydrocarbon mixtures from thermally cracked petroleum streams, but only certain, minimally sulfurous distillation fractions are used.

In the prior art, hydrocarbon mixtures are predominantly catalytically desulfurized under hydrogenating/dehydrogenating conditions, as described for example in Ullmann's Encyclopedia of Industrial Chemistry, 5th Edition, 1991, Vol. A18, p. 65–67, whereby the comprised sulfur compounds are converted into hydrogen sulfide in the course of the catalytic hydrogenation step of hydrotreating and then scrubbed out with a suitable solvent. However, the catalysts used will also hydrogenate the olefins to some extent, which is disadvantageous as regards further processing, for example by hydroformylation.

EP-A-653 477 proposes, as an alternative to catalytic hydrogenation, desulfurizing light oils by liquid-liquid extraction with nitrogenous heterocycles or amides, preferably methylpyrrolidone and 1,3-dimethyl-2-imidazolidinone. The immense disadvantage of this process is the low selectivity of the extractants used for the starting hydrocarbons, so that this process too leads to a reduction in the level of desirable olefins.

Selective liquid-liquid extraction processes for obtaining aromatic hydrocarbon mixtures from aromatic-nonaromatic mixtures as obtained for example in naphtha processing are described in Ullmann's Encyclopedia of Industrial Chemistry, 5th Edition, 1985, Vol. A3, p. 491–496. Some of the solvents mentioned therein (furfural, sulfurane, dimethyl sulfoxide, diethylene glycol) were used in EP-A-653 477 as comparative desulfurizing extractants. However, they have been found to be unsuitable for this purpose.

DE-A-20 40 025 describes a process for separating high-purity aromatics from hydrocarbon mixtures by liquid-liquid extraction with downstream extractive distillation using morpholine and/or N-substituted morpholines in conjunction with water as solvents. This method finds practical application in Krupp-Koppers' Morphylan process which is likewise described in Ullmann's Encyclopedia of Industrial Chemistry, 5th Edition, 1995, Vol. A3, p. 491–496. DE-A-20 40 025, however, does not concern itself with the problem of the selective removal of sulfur impurities from olefin-rich starting materials and the subsequent catalytic further processing of the desulfurized products.

It is an object of the present invention to provide a process for producing low-sulfur aliphatic compounds from olefin-rich intermediates without significantly reducing the olefin content.

We have found that this object is surprisingly achieved by a process for producing low-sulfur aliphatic compounds from olefin-rich starting materials contaminated with organic sulfur compounds, which comprises a) subjecting the sulfurous olefin-rich starting material to a single- or multi-stage liquid-liquid extraction with a morpholinic extractant, b) removing the extractant and the sulfur compounds comprised therein, and optionally c) subjecting the low-sulfur aliphatic product to further processing.

Suitable olefin-rich starting materials for this invention are olefins, olefin mixtures or olefin-rich hydrocarbon mixtures contaminated with organic and especially aromatic sulfur compounds. Preferred starting materials, however, are olefin-rich hydrocarbon mixtures as obtained for example in the petrochemical industry from thermal cracking processes (visbreakers, cokers). These hydrocarbon mixtures have a high level of organic, predominantly aromatic, sulfur compounds. Owing to their high olefin content, such hydrocarbon mixtures are ideal starting materials for the catalytic conversion to products such as aldehydes and alcohols. This invention, then, surprisingly makes it possible to desulfurize these mixtures with high selectivity, so that any poisoning of the catalysts required for the conversion reactions, for example nickel catalysts in the case of alcohol making, is avoided.

This invention surprisingly achieves selective desulfurization by using a morpholinic extractant which provides a relative depletion ratio of aromatic sulfur contamination to olefin of greater than about 10 at a pressure of about 1 atm and a temperature of about 25° C., for example within the range from about 10 to 30.

The relative depletion ratio is a measure of the selectivity of the extractant used. The higher the depletion ratio, the more aromatic sulfur compound and the less olefin transferred into the extractant phase.

The depletion ratio can be reliably determined for a certain extractant, for example by extraction of coker gasoline fractions, since their sulfur contamination consists predominantly of aromatic sulfur compounds. The relative depletion ratio is defined as the ratio of the percentage decrease in the sulfur content, determined by X-ray fluorescence spectroscopy, to the percentage decrease in the olefin content, determined in accordance with DIN 51774.

The morpholinic extractant used according to this invention is preferably selected from morpholine and morpholine derivatives which are N-substituted by an unsubstituted or hydroxyl-, amino- or mercapto-substituted $C_1$–$C_7$-acyl or $C_1$–$C_7$-alkyl radical with or without a hetero atom selected from the group consisting of oxygen, nitrogen and sulfur in the alkyl moiety, or mixtures thereof, optionally in combination with water or with a liquid which is miscible with the morpholine compound present therein. This includes ketones of nitrogen heterocycles, for example pyrrolidones, imidazolidinones, pyrimidinones, piperidones, pyrazolidinones and piperazinones, certain amides, for example dimethylformamide, diethylformamide and dimethylacetamide, sulfur-containing solvents, for example tetrahydrothiophene dioxide and dimethyl sulfoxide, and also glycols, for example ethylene glycol.

Suitable N-substituted morpholine compounds are in particular N-$C_1$–$C_7$-alkyl- and N-$C_1$–$C_7$-acyl-morpholine compounds. Examples hereof are N-methyl-, N-ethyl-, N-n-propyl-, N-n-butyl-, N-n-pentyl-, N-n-hexyl-, N-n-heptyl-, N-formyl-, N-acetyl-, N-propionyl-, N-butyryl-, N-valeryl-, N-hexanoyl- or N-heptanoyl-morpholine.

The amount of morpholine or N-substituted morpholine compound can vary within a wide range. In general, the weight ratio of morpholine or morpholine compound to hydrocarbon mixture is at least 1:1. More particularly, it is within the range from 2:1 to 5:1. The temperature and pressure at which the extraction is carried out are not critical. In general, the extraction is carried out at ambient temperature and atmospheric pressure. However, it is also possible to employ higher temperatures and pressures.

The liquid-liquid extraction is carried out in a conventional manner. Suitable apparatus and methods are known to the person skilled in the art and described for example in Ullmann, 3rd Edition, 1951, Vol. 1, p. 409–428. Examples are the use of sieve plate columns, extraction columns with mixing and stationary zones, for example stirred columns, and extraction batteries, for example mixer-settler apparatus. The extraction is preferably carried out in countercurrent. The extractant is preferably recycled.

The resulting desulfurized products have an essentially unchanged olefin content and an at least 60%, especially at least 80%, preferably at least 90%, lower sulfur content.

The desulfurized product produced according to the invention can be either a single olefin, an olefin mixture or an olefin-rich hydrocarbon mixture and be used as such for its intended purpose. The process of this invention then merely comprises steps a) and b) and thus constitutes a pure desulfurization process.

However, it can also be desirable to subject the desulfurized product to specific further processing in a subsequent step. Step c) can involve for example the distillative work-up of the resulting olefin mixtures or olefin-rich hydrocarbon mixtures.

Since, however, this invention is effective in removing in particular those sulfur compounds which are known as catalyst poisons, for example thiophenes, the resulting desulfurized olefin mixtures are preferably further processed in catalytic processes, for example by hydroformylation, to form higher alcohols or aldehydes.

The present invention accordingly also provides for the use of the abovementioned morpholinic extractants for desulphurizing olefins, olefin mixtures or olefin-rich hydrocarbon mixtures.

The Examples which follow illustrate the invention.

A coker gasoline fraction having a sulfur content (determined by X-ray fluorescence spectroscopy) of from 6200 to 7100 ppm was used as starting hydrocarbon mixture for the liquid-liquid extraction. The olefin content was determined in the form of the bromine number in accordance with DIN 51 774 Parts 1–3, Aug. 1975, and was found to be within the range from 64 to 71 g/100 g.

Representative Example 1

The starting hydrocarbon mixture was treated according to this invention by liquid-liquid extraction in a single-stage stirring trial using N-formylmorpholine (NFM) as extractant.

| The following conditions were set: | |
|---|---|
| NFM/hydrocarbon mixture ratio: | 3/1 (kg/kg) |
| Pressure: | 1.013 bar |
| Temperature: | 25 ° C. |
| **The following results were obtained:** | |
| Decrease in olefin content (%) | 3 |
| Decrease in sulfur content (%) | 66 |
| Depletion ratio | 22 |

Comparative Example 1

The starting hydrocarbon mixture was treated by liquid-liquid extraction in a single-stage stirring trial using N-methyl-2-pyrrolidone (NMP) as extractant under the same conditions as in Representative Example 1.

| The following results were obtained: | |
|---|---|
| Decrease in olefin content (%) | 25 |
| Decrease in sulfur content (%) | 78 |
| Depletion ratio | 3.1 |

Representative Example 2

The starting hydrocarbon mixture was treated according to this invention by liquid-liquid extraction in a six-stage mixer-settler apparatus.

| The following conditions were set: | |
|---|---|
| Extractant: | N-formylmorpholine (NFM) |
| NFM/HC mixture ratio: | 3.5/1 ($(kg \cdot h^{-1})/(kg \cdot h^{-1})$) |
| Pressure: | 1.013 bar |
| Temperature: | 25° C. |
| **The following results were obtained:** | |
| Decrease in olefin content (%) | 7 |
| Decrease in sulfur content (%) | 95 |
| Depletion ratio | 13.5 |

The comparison between Representative Example 1, Comparative Example 1 and Representative Example 2 shows that the use of NFM as an extractant makes it possible to desulfurize olefin-rich hydrocarbon mixtures essentially without reduction in the olefin content. Sulfur degradation is almost quantitative when a six-stage mixer-settler apparatus is used.

Comparative Example 2

The starting hydrocarbon mixture was catalytically treated under dehydrogenating conditions in accordance with the prior art.

| The following conditions were set: | |
|---|---|
| Catalyst: | $CoMo/Al_2O_3$ |
| Pressure: | 1.013 bar |
| WHSV: | 1.0 kg/(1·h) |
| $H_2$/hydrocarbon mixture: | 2/1 (mol/mol) |
| Temperature: | 500–600° C. |

-continued

The following results were obtained:

| Temperature (° C.) | 500 | 550 | 600 |
|---|---|---|---|
| Decrease in olefin content (%) | 57 | 49 | 33 |
| Decrease in sulfur content (%) | 66 | 52 | 20 |
| Depletion ratio | 1.2 | 1.2 | 0.6 |

Comparative Example 3

The starting hydrocarbon mixture was catalytically treated under hydrogenating conditions in accordance with the prior art.

The following conditions were set:

| | |
|---|---|
| Catalyst: | $Ag/Al_2O_3$ |
| Pressure: | 20 bar |
| WHSV: | 0.25 kg/(1·h) |
| $H_2$/HC mixture: | 2/1 (mol/mol) |
| Temperature: | 140–220° C. |

The following results were obtained:

| Temperature (° C.) | 180 | 220 |
|---|---|---|
| Decrease in olefin content (%) | 13 | 62 |
| Decrease in sulfur content (%) | 70 | 69 |
| Depletion ratio | 5.4 | 1.1 |

The comparison between Representative Example 2 and Comparative Examples 2 and 3 shows that, unlike prior art hydrogenating and dehydrogenating processes, the process of this invention makes it possible to desulfurize olefin-rich hydrocarbon mixtures selectively without reduction in the olefin content.

183/Hg

We claim:

1. A process for producing low-sulfur aliphatic products, from olefin-rich starting materials contaminated with organic sulfur compounds, which starting materials are selected from the class consisting of olefins and olefin mixtures, which process comprises:

a) subjecting the sulfurous olefin-rich starting materials to a single- or multi-stage liquid-liquid extraction with a morpholinic extractant and b) removing the extractant and the sulfur compounds comprised therein to obtain a low-sulfur aliphatic product having an essentially unchanged olefin content, which product is suitable for industrial use in hydroformylation processes.

2. A process as defined in claim 1, wherein the morpholinic extractant used provides a relative depletion ratio of aromatic sulfur contamination to olefin of greater than about 8 at a pressure of about 1 atm and a temperature of about 25° C.

3. A process as defined in claim 1, wherein the morpholinic extractant is selected from morpholine and morpholine derivatives which are N-substituted by an unsubstituted or hydroxyl-, amino- or mercapto-substituted $C_l$–$C_7$-acyl or $C_1$–$C_7$-alkyl radical with or without a hetero atom selected from the group consisting of oxygen, nitrogen and sulfur in the alkyl moiety, or mixtures thereof, optionally in combination with water or with a liquid which is miscible with the morpholine compound present therein.

4. A process as defined in claim 1, wherein the extractant is an N-$C_1$–$C_7$-acylmorpholine.

5. A process as defined in claim 1, wherein the extractant is N-formylmorpholine.

6. A process as defined in claim 1, wherein the extractant and the sulfurous olefin-rich starting material are present during the extraction step in a weight ratio of from about 1:1 to about 5:1.

7. A process as defined in claim 1, wherein the olefin-rich starting material to be desulfurized is an olefin mixture from the thermal cracking of residue oil.

8. A process as defined in claim 1, wherein stage b) affords a desulfurized product comprising an olefin mixture which is further separated in stage c).

9. A process as defined in claim 1, wherein stage b) affords a desulfurized product which is subjected to a catalytic conversion reaction in stage c).

10. A process as defined in claim 9, wherein the catalytic conversion reaction is an olefin hydroformylation with subsequent catalytic reduction of the carbonylation product to the corresponding alcohol.

11. A process as claimed in claim 2, wherein said olefin mixtures are olefin-rich mixtures obtained from thermal cracking processes.

* * * * *

UNITED STATES PATENT AND TRADEMARK OFFICE

CERTIFICATE OF CORRECTION

PATENT NO. : 6,207,043 B1
DATED : March 27, 2001
INVENTOR(S) : Vicari et al.

It is certified that error appears in the above-identified patent and that said Letters Patent is hereby corrected as shown below:

Column 6,
Line 14, "$C_1$-$C_7$-acyl" should be --$C_1$-$C_7$-acyl--.
Lines 30-33, delete "wherein stage b" and substitute --which further comprises subjecting the low-sulfur aliphatic product to a distillative work-up--.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*